US007619172B2

(12) United States Patent
Maehara et al.

(10) Patent No.: US 7,619,172 B2
(45) Date of Patent: Nov. 17, 2009

(54) MICRO SWITCH MOUNTING STRUCTURE AND AUTOMATIC ICEMAKER

(75) Inventors: Toshio Maehara, Gunma (JP); Eiji Kuroda, Gunma (JP); Yoshitaka Yokoi, Gunma (JP)

(73) Assignee: Nidec Servo Corporation, Gunma (JP)

( * ) Notice: Subject to any disclaimer, the term of this patent is extended or adjusted under 35 U.S.C. 154(b) by 14 days.

(21) Appl. No.: 12/015,550

(22) Filed: Jan. 17, 2008

(65) Prior Publication Data

US 2008/0237000 A1 Oct. 2, 2008

(30) Foreign Application Priority Data

Mar. 28, 2007 (JP) ..... 2007-083236

(51) Int. Cl.
*H01H 9/00* (2006.01)

(52) U.S. Cl. ..... 200/293; 200/573; 200/574

(58) Field of Classification Search ..... 200/61.2, 200/61.21, 573, 574, 293; 62/137, 353
See application file for complete search history.

(56) References Cited

U.S. PATENT DOCUMENTS 3,612,800 A * 10/1971 Slopa ..... 200/500
3,649,781 A * 3/1972 Johnsen et al. ..... 200/33 B
3,867,593 A * 2/1975 Kryah et al. ..... 406/34
4,305,310 A * 12/1981 Kah, Jr. ..... 74/568 T
4,746,780 A * 5/1988 Resh ..... 200/294
5,213,205 A * 5/1993 Laubach et al. ..... 200/293
5,217,301 A * 6/1993 Munz et al. ..... 362/394
5,823,323 A * 10/1998 Seymour et al. ..... 200/308
5,970,725 A * 10/1999 Lee ..... 62/137
6,278,070 B1 * 8/2001 Neubauer et al. ..... 200/61.27
6,743,986 B2 * 6/2004 Dirnberger ..... 200/50.1

FOREIGN PATENT DOCUMENTS

| | | | |
|---|---|---|---|
| JP | 45-4273 | B | 2/1970 |
| JP | 60-158517 | A | 8/1985 |
| JP | 05-325730 | A | 12/1993 |
| JP | 08-240366 | A | 9/1996 |
| JP | 2001-289349 | A | 10/2001 |

* cited by examiner

*Primary Examiner*—Michael A Friedhofer
(74) *Attorney, Agent, or Firm*—Keating & Bennett, LLP

(57) ABSTRACT

A micro switch is mounted onto a mounting base attached to a controller of an automatic icemaker. The micro switch generates a signal for controlling the amount of water to be filled in an ice tray. The micro switch is fixed to the mounting base by the first fixing member and the second fixing member. The first fixing member is inserted through a mounting hole formed in a case of the micro switch. The second fixing member is arranged on a surface of the mounting base on an opposite side of a surface mounted with the micro switch, and is fixed to the first fixing member.

19 Claims, 8 Drawing Sheets

MICRO SWITCH MOUNTING STRUCTURE AND AUTOMATIC ICEMAKER

BACKGROUND OF THE INVENTION

1. Field of the Invention

The present invention relates to an automatic icemaker installed in an ice compartment of a refrigerator, and in particular, to a mounting structure for a micro switch for adjusting the amount of water to be filled in an ice tray for ice making.

2. Description of the Related Art

Conventionally, in an automatic icemaker installed in an ice compartment of a refrigerator, water is filled in an ice tray for ice making. In order to obtain a constant amount of ice, the amount of filled water should not be varied. However, due to influences of a diameter and water pressure of a water supply pipe in each house, the amount of water filled in the ice tray varies. Thus, the time that a water-filling valve is kept open is adjusted to decrease variation in the amount of filled water.

In accordance with product specification of the automatic icemaker, water filling time is determined to be a value such as 5±0.5 seconds, 5.5±0.5 seconds, or 6±0.5 seconds. However, even when the automatic icemaker is assembled to enable such setting, there is still caused variation in water filling time by a few seconds. In order to keep the water filling time within such specification, the water filling time is adjusted when the automatic icemaker is shipped.

Referring to FIG. 6, an exemplary conventional automatic icemaker is described below. FIG. 6 is a perspective view of an exemplary micro switch mounting structure in the conventional automatic icemaker.

As shown in FIG. 6, in the conventional icemaker, a micro switch 9*a* is fixed to a mounting base 10*a* with first screws 16*a*, 17*a* respectively inserted into two holes 913*a* formed in the micro switch 9*a*. One of two points fixed by the first screws 16*a*, 17*a* is connected with one end of a movable arm 12*a*. The other end of the movable arm 12*a* is attached to the mounting base 10*a* via a second screw 3*a* and a spring 4*a*. The position of the micro switch 9*a* is adjusted by forcibly pushing/pulling the movable arm 12*a* due to the second screw 3*a* and the spring 4*a*. Thus, materials for the second screw 3*a* and the spring 4*a* have been required to be thickener and stronger so as to push/pull the movable arm 12*a*. In addition, a member for supporting the second screw 3*a* and the spring 4*a* has been required to be excellent in strength.

When a high-strength member is used for the mounting base 10*a* which supports the second screw 3*a* and the spring 4*a*, the mounting base 10*a* should be made of metal. In such a case, an electrically insulating member 14*a* has been required to be interposed between the micro switch 9*a* and the mounting base 10*a* in order to secure an insulation distance and a spacial distance between a terminal of the micro switch 9*a* and the mounting base 10*a*.

A plastic case is generally used for the micro switch 9*a*. In the conventional icemaker, the case is deformed when the first screws 16*a*, 17*a* are tightened by strong torque with respect to the micro switch 9*a*. To the contrary, when the torque for tightening the first screws 16*a*, 17*a* is reduced, the micro switch 9*a* cannot be securely fixed. Thus, problems have occurred such that the micro switch 9*a* is displaced while shipping the automatic icemaker and that the micro switch 9*a* is displaced in a long period of use to cause variations in the amount of water filled in the ice tray in comparison with the filled amount in an early stage of use. In order to solve such problems, highly accurate torque management has been required for tightening the first screws 16*a*, 17*a* when the micro switch 9*a* is fixed to the mounting base 10*a*.

Such adjustment of the micro switch 9*a* using the movable arm 12*a* is sometimes performed by a consumer in a market as well as is performed by a manufacturer prior to shipment of the automatic icemaker. Accordingly, the adjustment is required to be easy and repeatable.

SUMMARY OF THE INVENTION

According to a preferred embodiment of the present invention, an automatic icemaker includes a motor; a gear mechanism having a drive shaft serving as an output axis and engaging with the motor; a cam attached to the drive shaft and having a substantially V-shaped cutout on an outer peripheral surface thereof; a micro switch having a switch portion in contact with the outer peripheral surface of the cam; and a mounting base on which the micro switch is mounted.

According to another preferred embodiment of the present invention, a mounting structure including the mounting base and the micro switch mounted on the mounting base is provided. The micro switch is fixed to the mounting base using a first fixing member and a second fixing member. The first fixing member is inserted through a mounting hole provided in the micro switch, and extends from a mounting surface and a fixing surface of the mounting base which are opposite to each other. On the mounting surface is mounted the micro switch. The second fixing member is attached to a portion of the first fixing member protruding from the fixing surface of the mounting base. Accordingly, the micro switch is interposed between the first fixing member and the mounting base by the first fixing member and the second fixing member.

Other features, elements, advantages and characteristics of the present invention will become more apparent from the following detailed description of preferred embodiments thereof with reference to the attached drawings.

BRIEF DESCRIPTION OF THE DRAWINGS

FIGS. 3A and 3B show an exemplary micro switch mounted in the automatic icemaker according to a preferred embodiment of the present invention, wherein FIG. 3A is a plan view of the micro switch when seen along an arrow C in FIG. 3B, and FIG. 3B is a plan view of the micro switch when seen from a second surface thereof.

FIGS. 4A and 4B show an exemplary mounting base mounted in the automatic icemaker according to a preferred embodiment of the present invention, wherein FIG. 4A is a plan view of the mounting base when seen from its mounting-surface side, and FIG. 4B is a plan view of the mounting base when seen from its fixing-surface side.

DETAILED DESCRIPTION OF PREFERRED EMBODIMENTS

Figure 1:
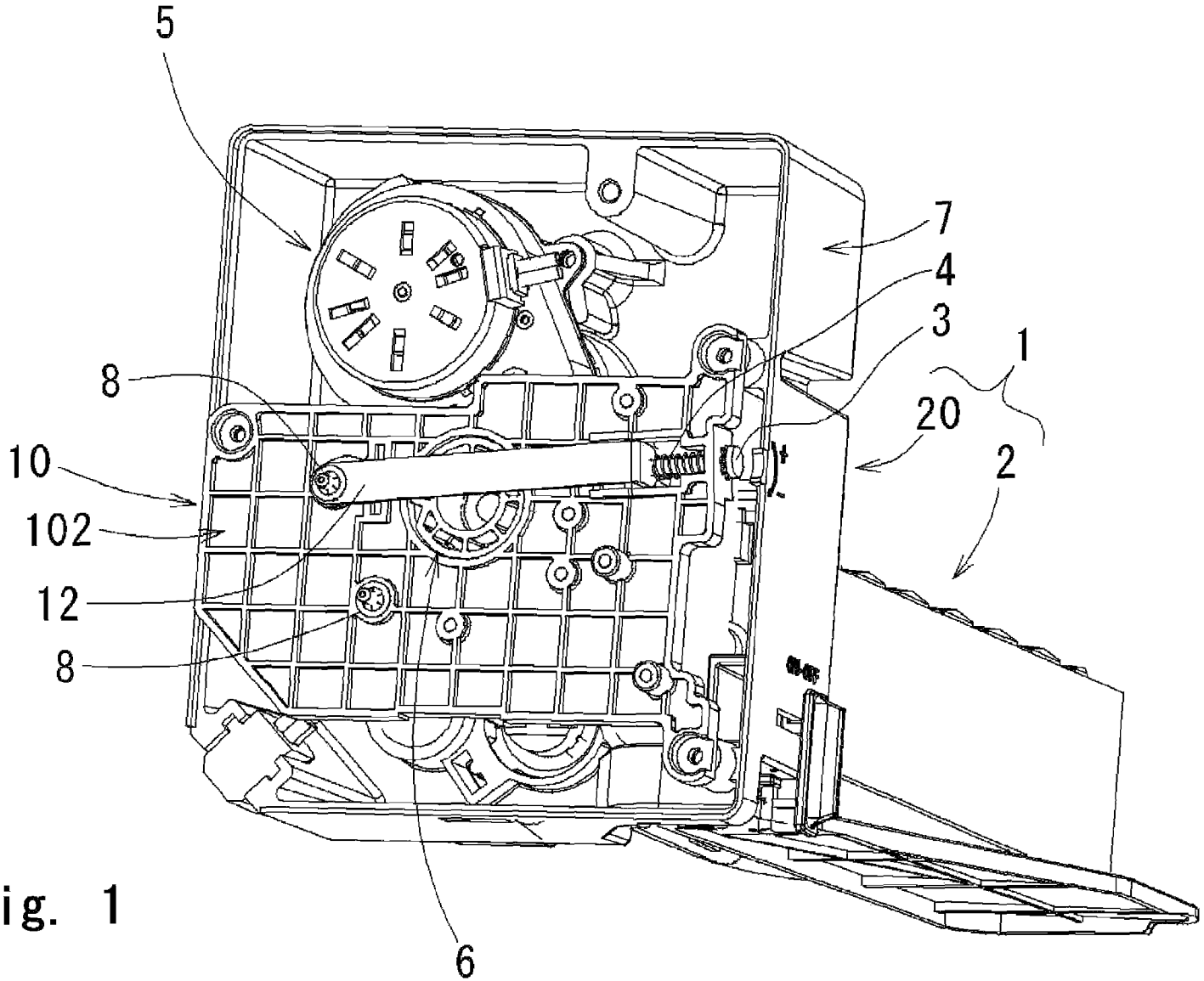
FIG. 1 is a perspective view of an automatic icemaker according to a preferred embodiment of the present invention.

Referring to FIGS. 1 through 5, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated.

Figure 2:
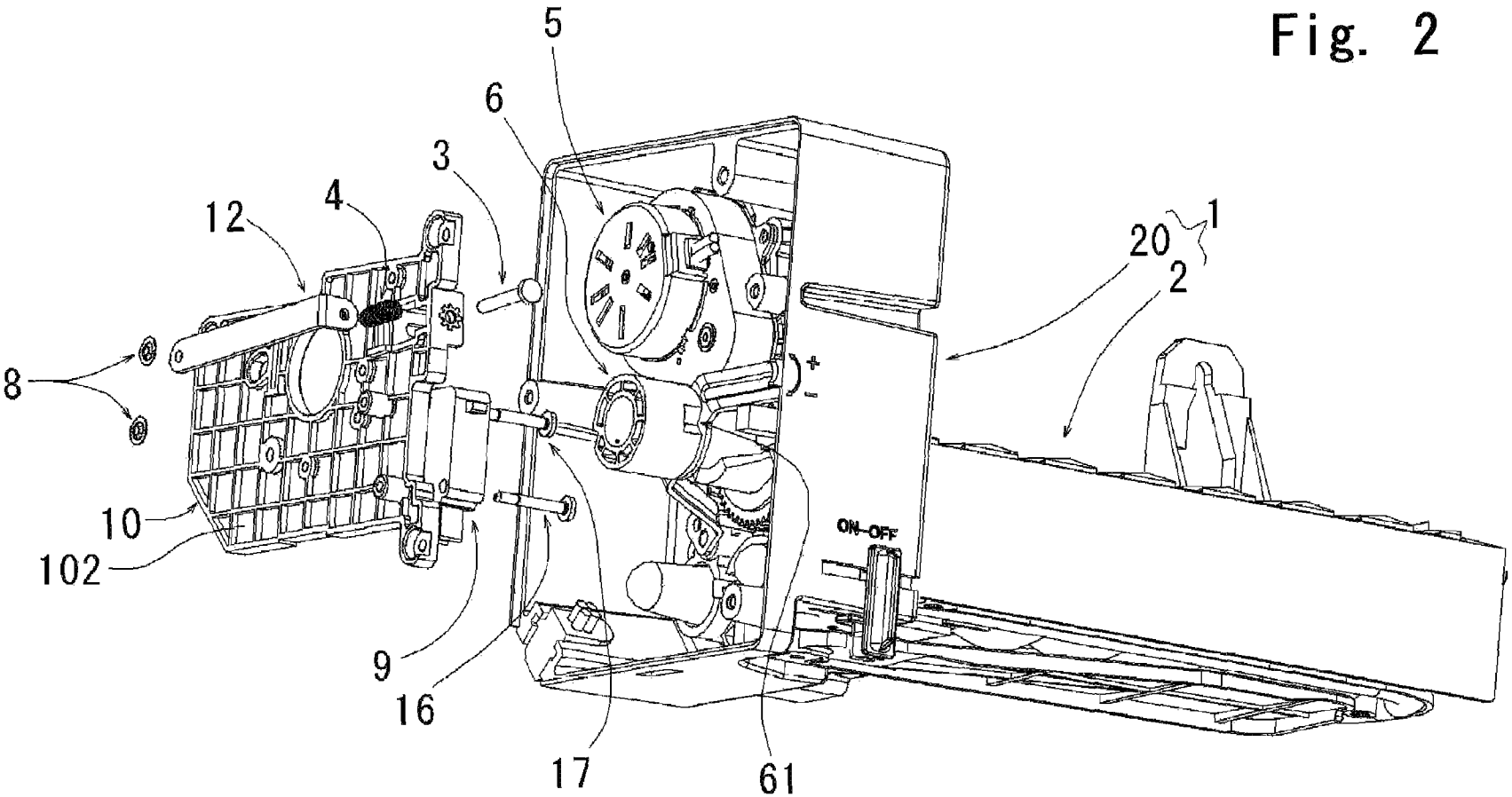
FIG. 2 is an exploded view of the automatic icemaker of FIG. 1.

A structure of an automatic icemaker according to a preferred embodiment of the present invention is now described, referring to FIGS. 1 and 2. FIGS. 1 and 2 are a perspective view and an exploded view of the automatic icemaker according to the present preferred embodiment. The automatic icemaker is installed in an ice compartment (not shown) of a refrigerator (not shown). A water supply pipe (not shown) for supplying water to the automatic icemaker is set in the refrigerator main body. A water-filling valve (not shown) is arranged at a distal end of the water supply pipe. The water-filling valve can electrically fill water and stop filling water in accordance with an ON/OFF signal.

Referring to FIG. 1, the automatic icemaker 1 is provided with an ice tray 2 which can store water supplied from a water supply pipe through a water-filling valve, and a controller 20 which can control the setting of the amount of water filled in the ice tray 2 and discharge of ice from the ice tray 2.

The controller 20 includes a motor 5 and a gear mechanism (not shown) engaging with the motor 5. The gear mechanism has a driving shaft as its output shaft. The controller 20 also includes an approximately cylindrical cam 6 attached to the drive shaft of the gear mechanism. The cam 6 has a substantially V-shaped cutout on its outer peripheral surface. In the controller 20, a micro switch 9 (see FIG. 2) is arranged to generate a signal for controlling the amount of water to be filled in the ice tray 2 via the cam 6. The micro switch 9 is mounted on a mounting base 10. The controller 20 further includes a movable arm 12 fixed to the micro switch 9 and the mounting base 10, an adjusting screw 3 and a spring 4 which can move the movable arm 12 in a predetermined direction, and a chassis 7 for accommodating the above components therein. In this preferred embodiment, the chassis 7 is made of resin. In this preferred embodiment, the movable arm 12 and the ice tray 2 are made of metal.

Referring to FIG. 2, the micro switch 9 is fixed to a mounting surface 101 (see FIG. 4) of the mounting base 10, i.e., the ice-tray side surface of the mounting base 10. The movable arm 12 is attached to a fixing surface 102 of the mounting base 10 opposite to the mounting surface 101. That is, the movable arm 12 is attached to the surface not facing the ice tray 2. The micro switch 9 is fixed to the mounting base 10 by two first fixing members 16, 17, two second fixing members 8 respectively fixed to the first fixing members 16, 17 from the fixing surface 102 side of the mounting base 10. In this preferred embodiment, the first fixing members 16, 17 preferably are pins, and the second fixing members 8 are push nuts.

By using the pins as the first fixing members 16, 17 and the push nuts as the second fixing members 8, it is not required to perform highly accurate torque management which is necessary for a case of using a conventional screw. Specifically, it is only required to manage press fit height of the push nuts as the second fixing members 8 fit into the pins as the first fixing members 16, 17. For such management of the press fit height, the second fixing members 8 need only to be press fitted so that the micro switch 9 is fixed to the mounting base 10 with no space therebetween. As a result, it is possible to improve work efficiency of a manufacturer to fix the micro switch 9 to the mounting base 10. Further, the manufacturer can easily and accurately mount the micro switch 9 onto the mounting base 10 since it is unnecessary to perform the highly accurate torque management as conventional required.

A substantially V-shaped cutout 61 is formed on a portion of then outer peripheral surface of the cam 6. The cam 6 is rotated by the motor 5 via the gear mechanism. The outer peripheral surface of the cam 6 is in contact with a switch portion 93 (see FIG. 3) of the micro switch 9. The cutout 61 of the cam 6 forms a portion not in contact with the micro switch 9. With such arrangements, the switch portion 93 of the micro switch 9 can be turned ON/OFF.

Figure 3A:
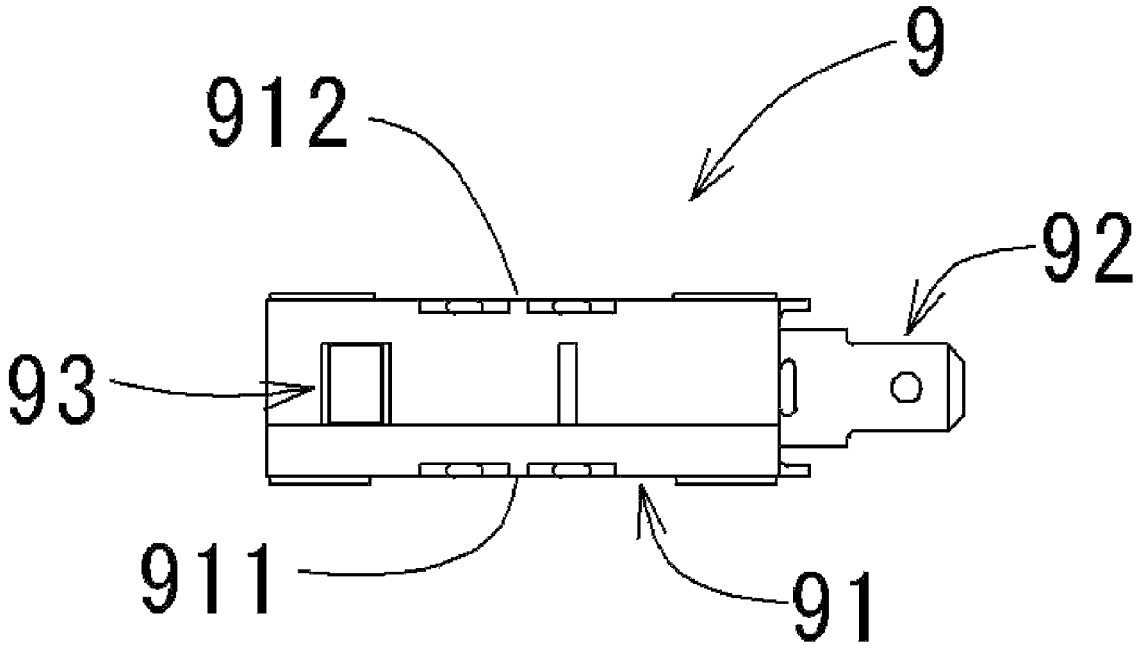
Figure 3B:
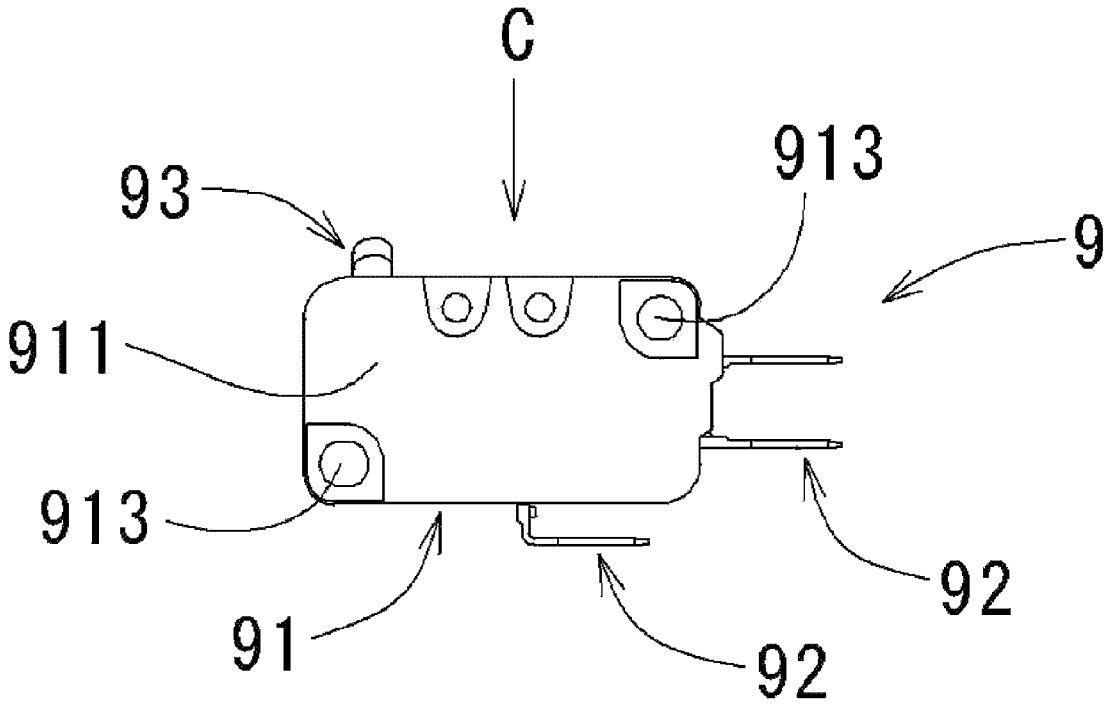
Figure 4A:
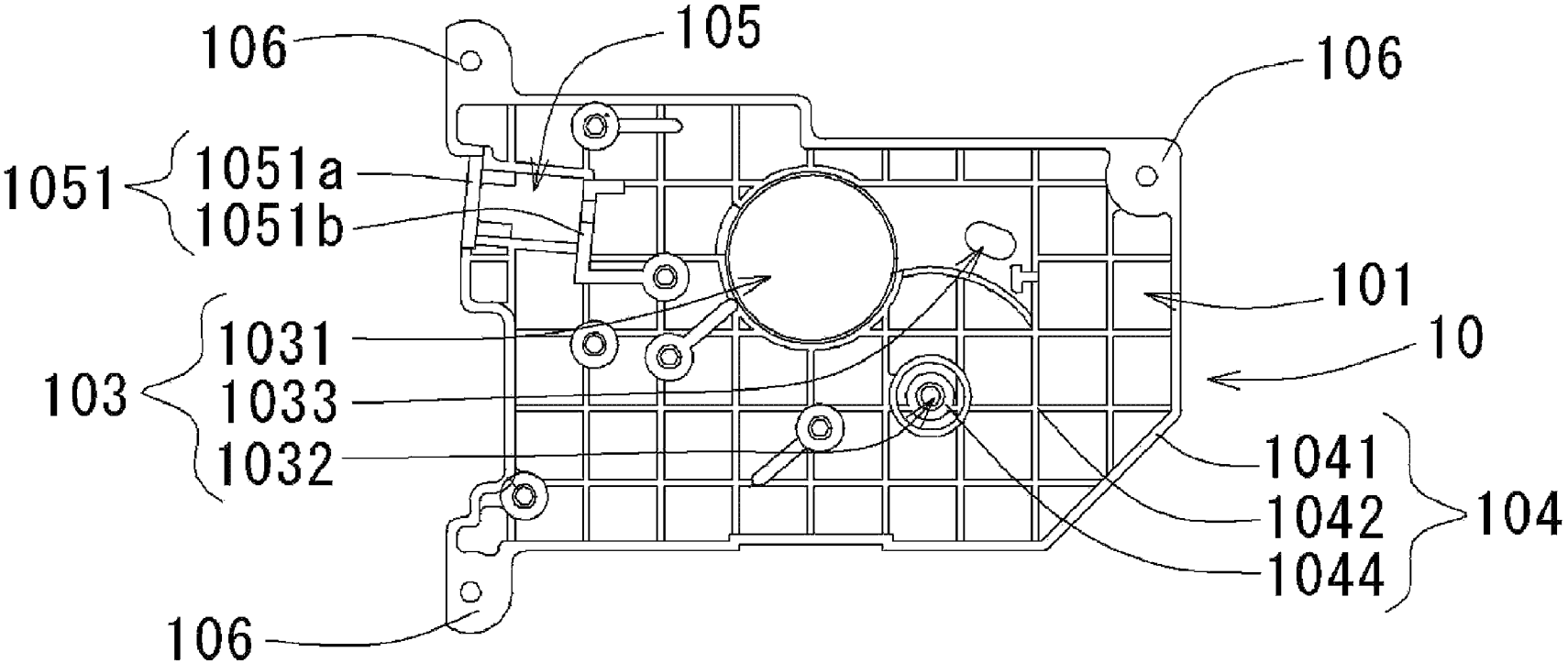
Figure 4B:
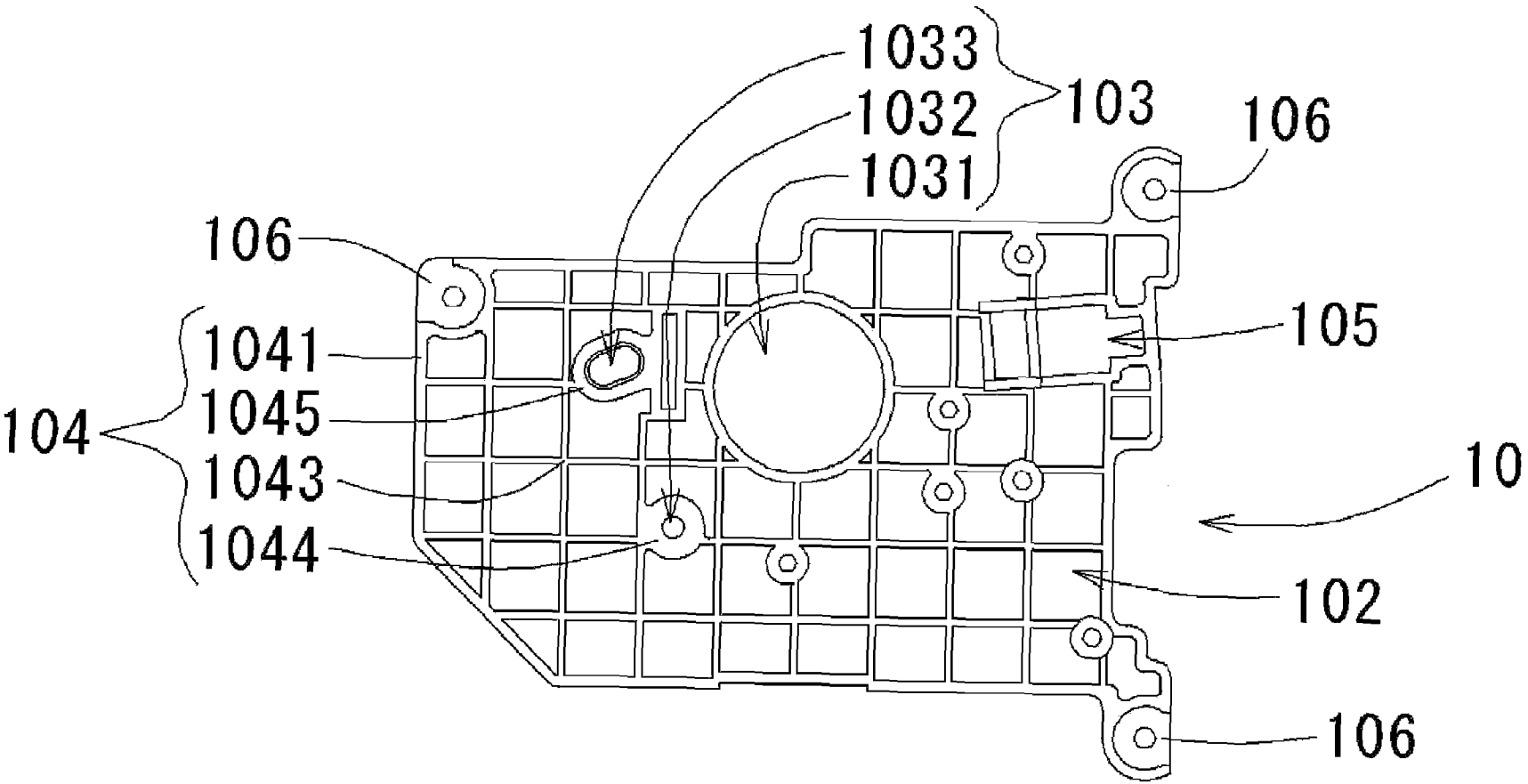
Figure 5:
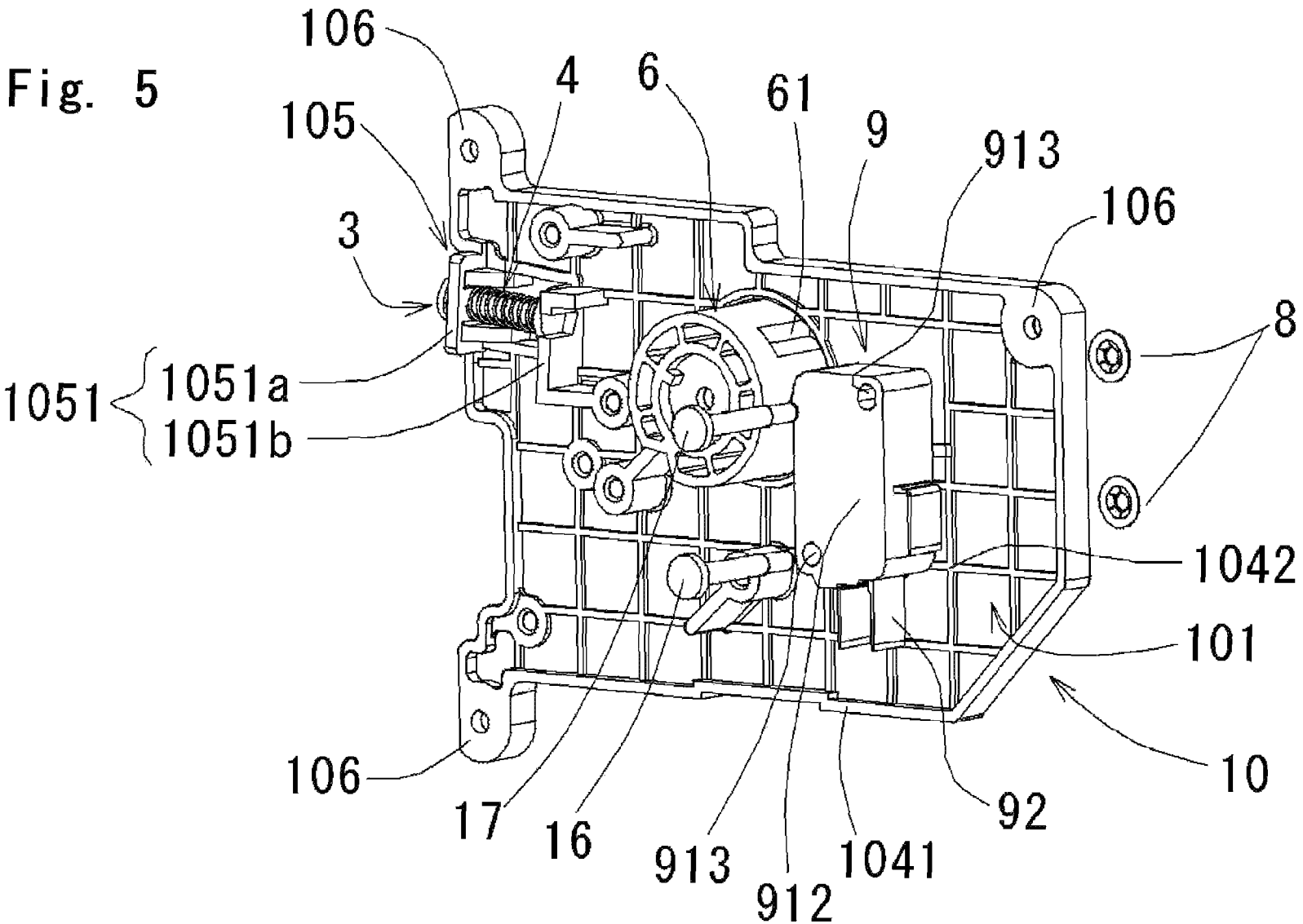
FIG. 5 is an exploded view showing a structure for fixing the micro switch to the mounting base.
Figure 6:
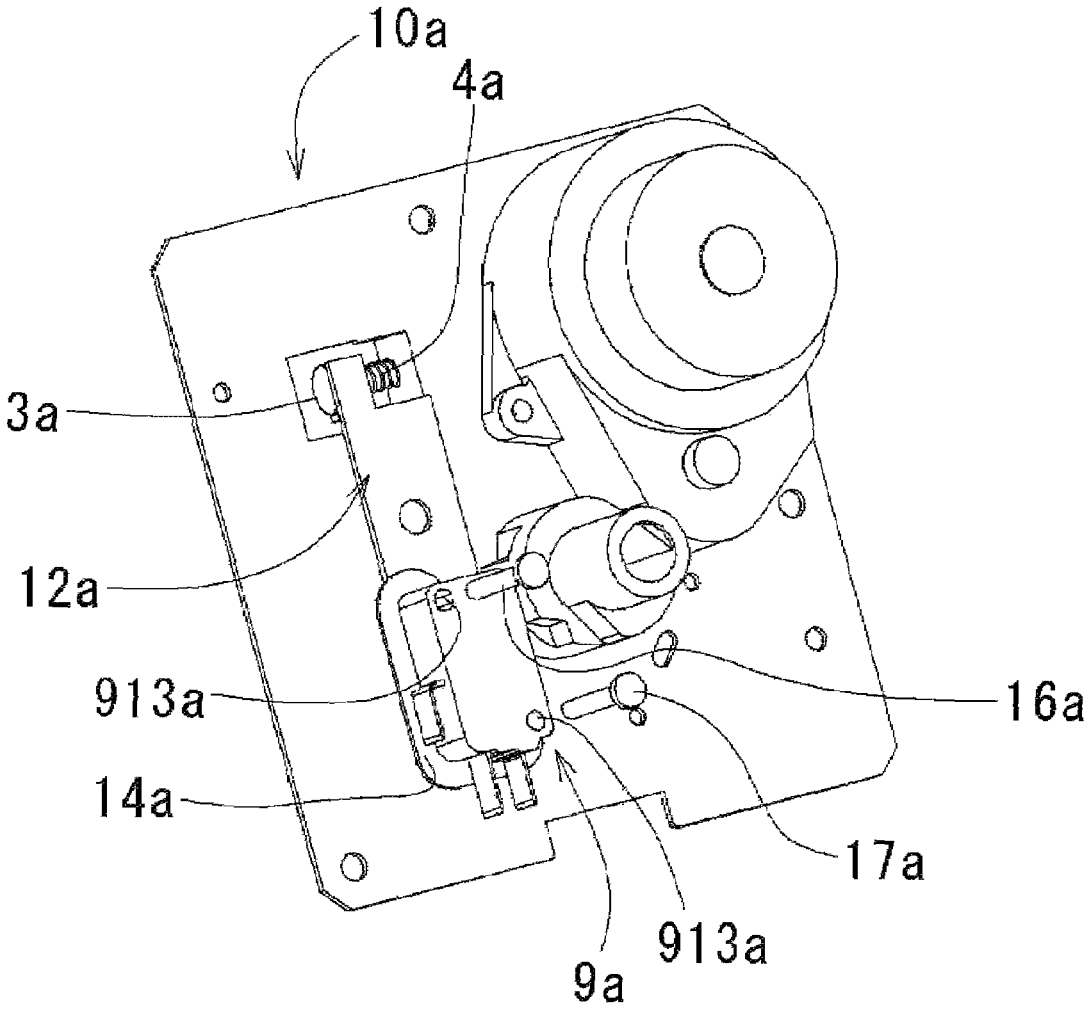
Fig. 6 PRIOR ART
FIG. 6 is a perspective view showing components fixed to a mounting base of an exemplary conventional automatic icemaker.

Next, there is described an exemplary structure for mounting the micro switch 9 onto the mounting base 10 of the automatic icemaker 1 of this preferred embodiment, referring to FIGS. 3A, 3B, 4A, 4B, and 5. FIGS. 3A and 3B show an exemplary structure of the micro switch 9 of this preferred embodiment; FIG. 3A is a side view when the micro switch 9 is seen along arrow C in FIG. 3B; and FIG. 3B is a plan view when the micro switch 9 is seen from its second surface 912 side. FIGS. 4A and 4B show an exemplary structure of the mounting base 10 of this preferred embodiment; FIG. 4A is a plan view when the mounting base 10 is seen from the mounting-surface side; and FIG. 4B is a plan view when the mounting base 10 is seen from the fixing-surface side. FIG. 5 is a perspective view showing the structure including the micro switch 9 of FIGS. 3A and 3B mounted on the mounting base 10 of FIGS. 4A and 4B, seen from the mounting-surface side of the mounting base 10.

Referring to FIGS. 3A and 3B, the micro switch 9 includes a case 91, a plurality of terminals 92 made of conductive material, e.g., meal, and extending from the case 91, and a switch portion 93 provided on the case 91. In this preferred embodiment, the case 91 preferably has an approximately rectangular solid shape, i.e., has first and second main surfaces 911 and 912 opposite to each other and side surfaces substantially perpendicular to the main surfaces. For example, the case 91 is preferably made of resin. The first main surface 911 of the case 91 faces the mounting surface 101 of the mounting base 10. The case 91 is provided with at least one mounting hole 913 serving as through holes extending from the first main surface 911 to the second main surface 912. In this preferred embodiment, the mounting holes 913 are provided at two positions in the case 91.

Referring to FIGS. 4A and 4B, the mounting base 10 is made of electrically insulating material, e.g., electrically insulating resin. In this preferred embodiment, the mounting base 10 is formed into a plate shape. The mounting base 10 includes: a plurality of attaching portions 106 for attaching the mounting base 10 to the chassis 7 of the controller; the mounting surface 101 which faces the ice tray 2 and on which the micro switch 9 is mounted; the fixing surface 102 which is on the side opposite to the ice tray 2 and on which the second fixing members 8 is arranged; and an adjusting portion 105 on which the adjusting screw 3 and the spring 4 are arranged. The adjusting screw 3 is fixed to the first end of the movable arm 12 (see FIG. 1).

The mounting base 10 is provided with a plurality of openings 103 extending from the mounting surface 101 to the fixing surface 102. The openings 103 include a first opening 1031 allowing the cam 6 to be inserted thereinto, a second opening 1032 and a third opening 1033 allowing the first fixing members 16, 17 for fixing the micro switch 9 to be respectively inserted thereinto. In this preferred embodiment, the third opening 1033 preferably has an approximately oval shape.

The mounting base 10 is also provided with ribs 104 for improving the strength of the mounting surface 101 and that of the fixing surface 102. The ribs 104 include first ribs 1041 respectively formed on outer peripheral edges of the mounting surface 101 and the fixing surface 102, a second rib 1042 formed into an approximately lattice shape on the mounting surface 101, a third rib 1043 formed into an approximately lattice shape on the fixing surface 102, fourth ribs 1044 respectively formed on peripheral edges of the second opening 1032 on the mounting surface 101 and on the fixing surface 102, and fifth ribs 1045 respectively formed on peripheral edges of the third opening 1033 on the mounting surface 101 and on the fixing surface 102.

The adjusting portion 105 has plate-like walls 1051 which are provided on the mounting surface 101 and extend away from the mounting surface 101. The walls 1051 include a first wall 1051*a* and a second wall 1051*b* separated from each other. The first wall 1051*a*, which is a closer one of the walls 1051 to the outer peripheral edge of the mounting base 10, is provided with a through hole allowing the adjusting screw 3 to be inserted therethrough. The second wall 1051*b* arranged inside the first wall 1051*a* is provided with a recess allowing the adjusting screw 3 to be inserted therethrough. The spring 4 is accommodated between the first wall 1051*a* and the second wall 1051*b*. The first end of the movable arm 12 is fixed to the mounting base 10 by the adjusting screw 3 between the first wall 1051*a* and the second wall 1051*b*.

Referring to FIG. 5, the micro switch 9 is mounted on the mounting surface 101 of the mounting base 10 to be in contact with the second rib 1042. The first fixing members 16, 17 are respectively inserted through the mounting holes 913 as well as the second opening 1032 and the third opening 1033.

Each of the first fixing members 16, 17 has a rod-like extending portion to be inserted through the mounting hole 913 of the micro switch 9. For example, the extending portion preferably is in the form of an approximately circular column in this preferred embodiment. Each of the first fixing members 16, 17 also has a head portion having a diameter larger than that of the extending portion and that of the mounting hole 913. The head portion has a surface to be in contact with the second main surface 912 of the micro switch 9. The extending portion extends substantially perpendicularly to that surface of the head portion. With this configuration, it is possible to position the first fixing members 16, 17 with respect to the micro switch 9.

The second fixing members 8 are attached to the first fixing members 16, 17 on the fixing-surface side of the mounting base 10. The second fixing member 8 attached to the first fixing member 17 is in contact with the fourth rib 1044 on the fixing surface 102, while the second fixing member 8 attached to the first fixing member 16 is in contact with the second end of the movable arm 12. Thus, the movable arm 12 is interposed between the second fixing members 8 and the fixing surface 102 of the mounting base 10. In particular, the movable arm 12 is in contact with the fifth rib 1045 on the fixing surface 102.

The micro switch 9 is interposed between the head portions of the first fixing members 16, 17 and the second rib 1042 on the mounting surface 101 of the mounting base 10 via the first fixing members 16, 17 and the second fixing members 8.

Since the mounting base 10 is preferably made of resin, it is possible to provide a cheaper and lighter mounting base 10 as compared with a metal mounting base conventionally used.

In this preferred embodiment, the mounting base 10 provides electrical insulation because it is made of electrically insulating material, as described above. Thus, the terminals 92 of the micro switch 9 and the mounting surface 101 of the mounting base 10 can be electrically insulated from each other. Accordingly, there is provided a highly reliable automatic icemaker which can reduce or prevent short circuiting of the micro switch.

The micro switch 9 is mounted onto the mounting surface 101 of the mounting base 10, while the movable arm 12 is attached to the fixing surface 102 of the mounting base 10. Thus, it is possible to increase a creeping distance between the terminals 92 of the micro switch 9 and the movable arm 12. Therefore, dielectric strength can be improved between the terminals 92 and the movable arm 12.

Moreover, the pins are used as the first fixing members 16, 17 and the push nuts are used as the second fixing members 8 in this preferred embodiment. Thus, excessive load is prevented from being applied to the mounting base 10 when the micro switch 9 is mounted onto the mounting base, unlike the screws used in the conventional automatic icemaker. Therefore, resin can be used as the material of the mounting base 10, although resin mounting bases generally have lower strength than the conventional metal mounting bases.

There has been described the automatic icemaker according to a preferred embodiment of the present invention. However, the present invention is not limited to the above.

For example, the first fixing members 16, 17 and the second fixing members 8 are embodied respectively as the pins and the push nuts in the above preferred embodiment. However, the present invention is not limited thereto. Any members can be used as the first fixing members 16, 17 and the second fixing members 8 as long as such members do not require highly accurate torque management as conventionally required.

Further, the mounting base 10 and the micro switch 9 are installed in the automatic icemaker 1 in the above preferred embodiment. However, the present invention is not limited thereto. The present invention is also applicable to any equipment utilizing a micro switch and a mounting base other than the automatic icemaker.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A mounting structure comprising:

a mounting base having a mounting surface and a fixing surface opposite thereto and a mounting hole extending from the mounting surface to the fixing surface;

a micro switch fixed to the mounting base, and having a first and a second main surfaces which are opposite to each other and a through hole which extends from one of the first and second main surfaces to the other, the first main surface facing the mounting surface of the mounting base;

a first fixing member including a head portion which has a surface facing the second main surface of the micro switch and a rod-like extending portion which extends from the surface of the head portion substantially perpendicularly thereto, the head portion being larger in diameter than the extending portion; and a second fixing member to be attached to the first fixing member to sandwich the micro switch and the head portion between the second fixing member and the head portion of the first fixing member; wherein the first fixing member is inserted through the through hole of the micro switch and the mounting hole of the mounting base, and the second fixing member is attached to the first fixing member on the fixing surface of the mounting base to sandwich the micro switch and the mounting base between the second fixing member and the head portion of the first fixing member;

the mounting base further includes an adjusting hole arranged to allow adjustment of a position of the micro switch; and the mounting base further includes a movable arm arranged to move a position of the micro switch, and one end of the movable arm is attached between the second fixing member and the second main surface of the micro switch and another end of the movable arm is attached to the mounting base.

2. The mounting structure according to claim 1, wherein the mounting base is made of electrically insulating material.

3. The mounting structure according to claim 1, wherein the mounting base has a rib arranged to support and strengthen the mounting base.

4. The mounting structure according to claim 3, wherein the rib is provided on an outer peripheral edge of the mounting base.

5. The mounting structure according to claim 3, wherein the rib is provided on the mounting surface in a region facing the micro switch and arranged to strengthen the region of the mounting surface.

6. The mounting structure according to claim 1, wherein the mounting base has a rib arranged in a surrounding region of the adjusting hole so as to strengthen the surrounding region.

7. The mounting structure according to claim 1, wherein the mounting base has a rib arranged on the fixing surface in a region facing the second fixing member and so as to strengthen the region.

8. The mounting structure according to claim 1, wherein the movable arm is made of metal and is fixed to the micro switch with the second fixing member on the fixing surface of the mounting base.

9. A mounting structure comprising:

a mounting base having a mounting surface and a fixing surface opposite thereto and a mounting hole extending from the mounting surface to the fixing surface;

a micro switch fixed to the mounting base, and having a first and a second main surfaces which are opposite to each other and a through hole which extends from one of the first and second main surfaces to the other, the first main surface facing the mounting surface of the mounting base;

a first fixing member including a head portion which has a surface facing the second main surface of the micro switch and a rod-shaped extending portion which extends from the surface of the head portion substantially perpendicularly thereto, the head portion being larger in diameter than the extending portion; and a second fixing member to be attached to the first fixing member to sandwich the micro switch and the head portion between the second fixing member and the head portion of the first fixing member; wherein the first fixing member is inserted through the through hole of the micro switch and the mounting hole of the mounting base, and the second fixing member is attached to the first fixing member on the fixing surface of the mounting base to sandwich the micro switch and the mounting base between the second fixing member and the head portion of the first fixing member; and the first fixing member is a pin and the second fixing member is a push nut.

10. An automatic icemaker comprising:

a motor;

a gear mechanism engaging with the motor and having a driving shaft as an output shaft;

an approximately cylindrical cam with an approximately V-shaped cutout formed on its outer peripheral surface, the cam being provided on the driving shaft;

a micro switch having a switch portion arranged to be in contact with the outer peripheral surface of the cam, the micro switch including a first and a second main surfaces opposite to each other and a through hole extending from one of the first and second main surfaces to the other;

a mounting base on which the micro switch is mounted, the mounting base having a mounting surface facing the first main surface of the micro switch, a fixing surface, and a mounting hole arranged to mount the micro switch and extending from the mounting surface to the fixing surface;

a first fixing member including a head portion which has a surface to be in contact with the second main surface of the micro switch and a rod-shaped extending portion extending from the surface of the head portion substantially perpendicularly thereto;

a second fixing member attached to the first fixing member to sandwich the micro switch and the mounting base between the head portion of the first fixing member and the second fixing member; and an ice tray arranged to store water to make ice; wherein the first fixing member is inserted through the through hole of the micro switch and the mounting hole of the mounting base;

the second fixing member is attached to the first fixing member on the fixing surface of the mounting base to sandwich the micro switch and the mounting base between the head portion of the first fixing member and the second fixing member;

the mounting base further includes an adjusting hole arranged to allow adjustment of a position of the micro switch;

a movable arm arranged to move the position of the micro switch, the movable arm having a first end attached between the second fixing member and the second main surface of the micro switch; and an adjusting unit arranged to adjust a position of the first end of the movable arm by adjusting a position of a second end of the movable arm connected to the mounting base via the adjusting unit; and the adjusting unit is arranged to adjust the position of the micro switch by changing a position of the first end of the movable arm.

11. The automatic icemaker according to claim 10, wherein the mounting base is made of electrically insulating resin.

12. The automatic icemaker according to claim 10, wherein the mounting base is provided with a rib having an approximate lattice shape and arranged to strengthen the mounting base.

13. The automatic icemaker according to claim 10, wherein the mounting base is provided with a rib arranged to strengthen the mounting base on an outer peripheral edge thereof.

14. The automatic icemaker according to claim 10, wherein the mounting base is provided with a rib arranged in a region so as to come in contact with the second fixing member and so as to strengthen of the region.

15. The automatic icemaker according to claim 10, wherein the first fixing member is a pin and the second fixing member is a push nut.

16. The automatic icemaker according to claim 10, wherein the movable arm is made of metal and is fixed to the micro switch with the fixing surface of the mounting base interposed therebetween by the second fixing member.

17. The mounting structure according to claim 9, wherein the mounting base is made of electrically insulating resin.

18. The mounting structure according to claim 9, wherein the mounting base further includes an adjusting hole allowing positional adjustment of the micro switch;

the mounting case further includes a movable arm arranged to move a position of the micro switch; and one end of the movable arm is attached between the second fixing member and the second main surface of the micro switch and another end of the movable arm is attached to the mounting base.

19. The mounting structure according to claim 9, wherein the mounting base has a rib arranged to strengthen the mounting base.

* * * * *